US012156589B2

(12) United States Patent
Soetman et al.

(10) Patent No.: US 12,156,589 B2
(45) Date of Patent: Dec. 3, 2024

(54) MULTIFUNCTIONAL TABLE AND SLIDABLE HOLDER

(71) Applicant: Nonet Inc., Taipei (TW)

(72) Inventors: Wilco Wijnand Soetman, Taipei (TW); Beico Chiu, Taipei (TW); Wei-Hsiang Hung, Taipei (TW); Chun-Yi Lu, Taipei (TW); Xiang-Yi Zhan, Taipei (TW)

(73) Assignee: NONET INC., Taipei (TW)

( * ) Notice: Subject to any disclaimer, the term of this patent is extended or adjusted under 35 U.S.C. 154(b) by 233 days.

(21) Appl. No.: 17/940,193

(22) Filed: Sep. 8, 2022

(65) Prior Publication Data

US 2024/0081525 A1 Mar. 14, 2024

(51) Int. Cl.
*A47B 21/04* (2006.01)

(52) U.S. Cl.
CPC ..... *A47B 21/04* (2013.01)

(58) Field of Classification Search
CPC .. A47B 21/00; A47B 21/04; A47B 2200/0066
USPC ..... 108/25, 50.01
See application file for complete search history.

(56) References Cited

U.S. PATENT DOCUMENTS 5,237,935 A * 8/1993 Newhouse ..... A47B 83/001 108/50.02
5,568,773 A * 10/1996 Hung ..... A47B 21/0314 108/50.01
6,629,505 B1 * 10/2003 Cronk ..... A47B 21/06 108/50.02
8,276,523 B2 * 10/2012 Miller ..... A47B 21/0314 108/50.02
9,516,945 B2 * 12/2016 Johnson ..... A47B 21/06
10,492,601 B2 * 12/2019 Mirth ..... A47B 21/04
2005/0279257 A1 * 12/2005 Bettinger ..... A47B 21/06 108/50.02
2006/0081156 A1 * 4/2006 Gayhart ..... A47B 21/06 108/50.02
2017/0065076 A1 * 3/2017 Johnson ..... A47B 87/002
2018/0084904 A1 * 3/2018 Gosling ..... A47B 21/06
2021/0212453 A1 * 7/2021 Mulder ..... A47B 21/06
(Continued)

FOREIGN PATENT DOCUMENTS

CN 211582089 U 9/2020

*Primary Examiner* — Jose V Chen
(74) *Attorney, Agent, or Firm* — Birch, Stewart, Kolasch & Birch, LLP

(57) ABSTRACT

A multifunctional table includes a table body, a carrier member, and a holder. The table body includes a board and a support member connected to each other. The board has a table top and a groove. The carrier member is connected to the table body and includes a first slideway. The holder includes a slidable attaching portion and a holding portion connected to each other. The holding portion includes a first holding surface. The first holding surface corresponds to the groove when the slidable attaching portion is slidably attached to the first slideway in a first attached state. A holder includes a slidable attaching portion and a holding portion connected to each other. The holding portion includes a first holding surface and a second holding surface opposite to each other. The first holding surface and the second holding surface are asymmetrical about a central x axis of the holder.

16 Claims, 9 Drawing Sheets

(56) References Cited

U.S. PATENT DOCUMENTS

| | | | | |
|---|---|---|---|---|
| 2023/0363528 | A1* | 11/2023 | Fauzan | A47B 13/12 |
| 2023/0413993 | A1* | 12/2023 | Russell | A47B 13/16 |

* cited by examiner

A-A

MULTIFUNCTIONAL TABLE AND SLIDABLE HOLDER

BACKGROUND

Technical Field

The instant disclosure is related to a table, especially a multifunctional table with a slidable holder.

Related Art

As known to the inventor, current tables do not provide enough flexible storage options, and thus the user's items are usually directly placed or stacked on the table. This can lead to messiness. Furthermore, this can lead to accidental damage to the items. For example, a table known to the inventor provides a dent on the table board for notebook computer/tablet computer storage, but the depth of the dent is very shallow, and thus a large portion (such as over 50%) of the notebook computer or tablet computer stored in the dent is exposed. Consequently, it is easy for other objects to collide against the stored notebook computer or tablet computer.

SUMMARY

As above, the instant disclosure provides a multifunctional table having several flexible storage options for easier storage and improved user experience. The instant disclosure also provides a holder having two different holding surfaces for different holding purposes.

Some embodiments of the instant disclosure provide a multifunctional table comprising a table body, a carrier member, and a holder. The table body comprises a board and a support member connected to each other. The board has a table top and a groove. The carrier member is connected to the table body and comprises a first slideway. The holder comprises a slidable attaching portion and a holding portion connected to each other. The holding portion comprises a first holding surface. The first holding surface corresponds to the groove when the slidable attaching portion is slidably attached to the first slideway in a first attached state.

Some embodiments of the instant disclosure provide a holder comprising a slidable attaching portion and a holding portion connected to each other. The holding portion comprises a first holding surface and a second holding surface opposite to each other. The first holding surface and the second holding surface are asymmetrical about a central x axis of the holder.

As above, some embodiments of the instant disclosure provide a multifunctional table having a flexible storage option to easily store tablet computer and notebook computer, prevent accidental damage to the stored tablet computer and notebook computer, save table area, increase ventilation and heat dissipation of the stored tablet computer and notebook computer, and improve overall user experience. Some embodiments of the instant disclosure provide a holder having two different holding surfaces for different holding purposes.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
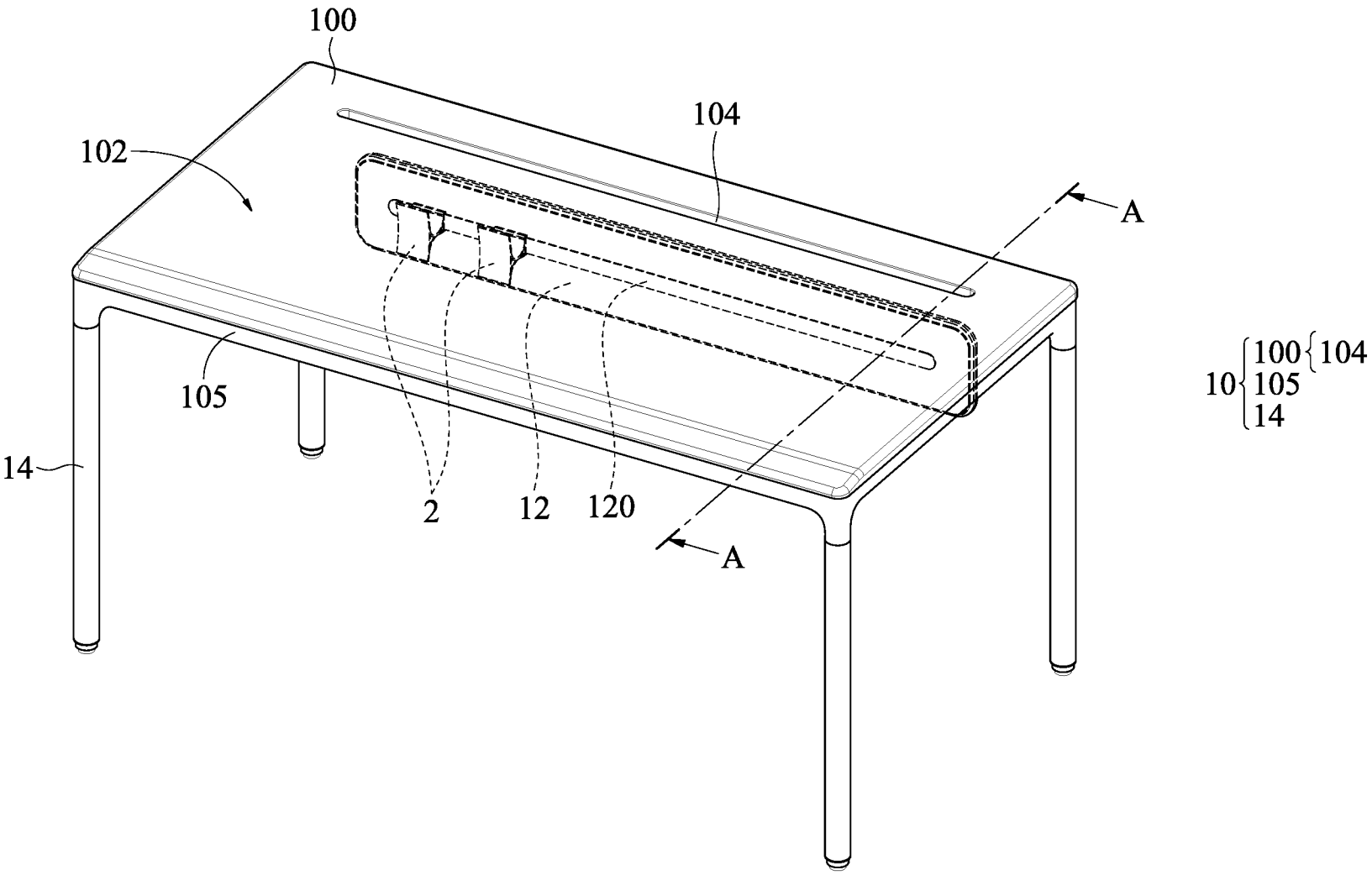
FIG. 1 illustrates a schematic three dimensional diagram of a multifunctional table according to an exemplary embodiment of the instant disclosure.

The foregoing and other technical contents, features, and effects of the instant disclosure can be clearly presented below in detailed description with reference to embodiments of the accompanying drawings. Thicknesses or sizes of the elements in the drawings illustrated in an exaggerated, omitted, or general manner are used to help a person skilled in the art to understand and read, and the size of each element is not the completely actual size and is not intended to limit restraint conditions under which the instant disclosure can be implemented and therefore have no technical significance. Any modification to the structure, change to the proportional relationship, or adjustment on the size should fall within the scope of the technical content disclosed by the instant disclosure without affecting the effects and the objectives that can be achieved by the instant disclosure. In the following detailed description, the term "connect" may refer to any direct or indirect connection.

FIG. 1 illustrates a schematic three dimensional diagram of a multifunctional table 1 according to an exemplary embodiment of the instant disclosure. Please refer to FIG. 1. The multifunctional table 1 may be applied to environments where tables can be used such as, but not limited to, working environments and living environments. In some embodiments of the instant disclosure, the multifunctional table 1 comprises a table body 10, a carrier member 12, and a holder 2. The table body 10, the carrier member 12, and the holder will be further illustrated in the following paragraphs with the aid of accompanying figures.

Please refer to FIG. 1. The table body 10 comprises a board 100 and a support member 14 connected to each other. The board 100 and the support member 14 may be connected to each other directly or through other structures. In this embodiment, the board 100 and the support member 14 are connected to each other through a frame 105 of the table body 10. The multifunctional table 1 may comprise one or more support members 14. For example, in this embodiment, the multifunctional table 1 comprises four support members 14. The board 100 has a table top 102 and a groove 104. The groove 104 has a width of 1-5 cm (centimeter) and extends from the table top 102 to the bottom of the board 100, and thus objects within a certain thickness are allowed to pass through the groove 104.

Figure 2A:
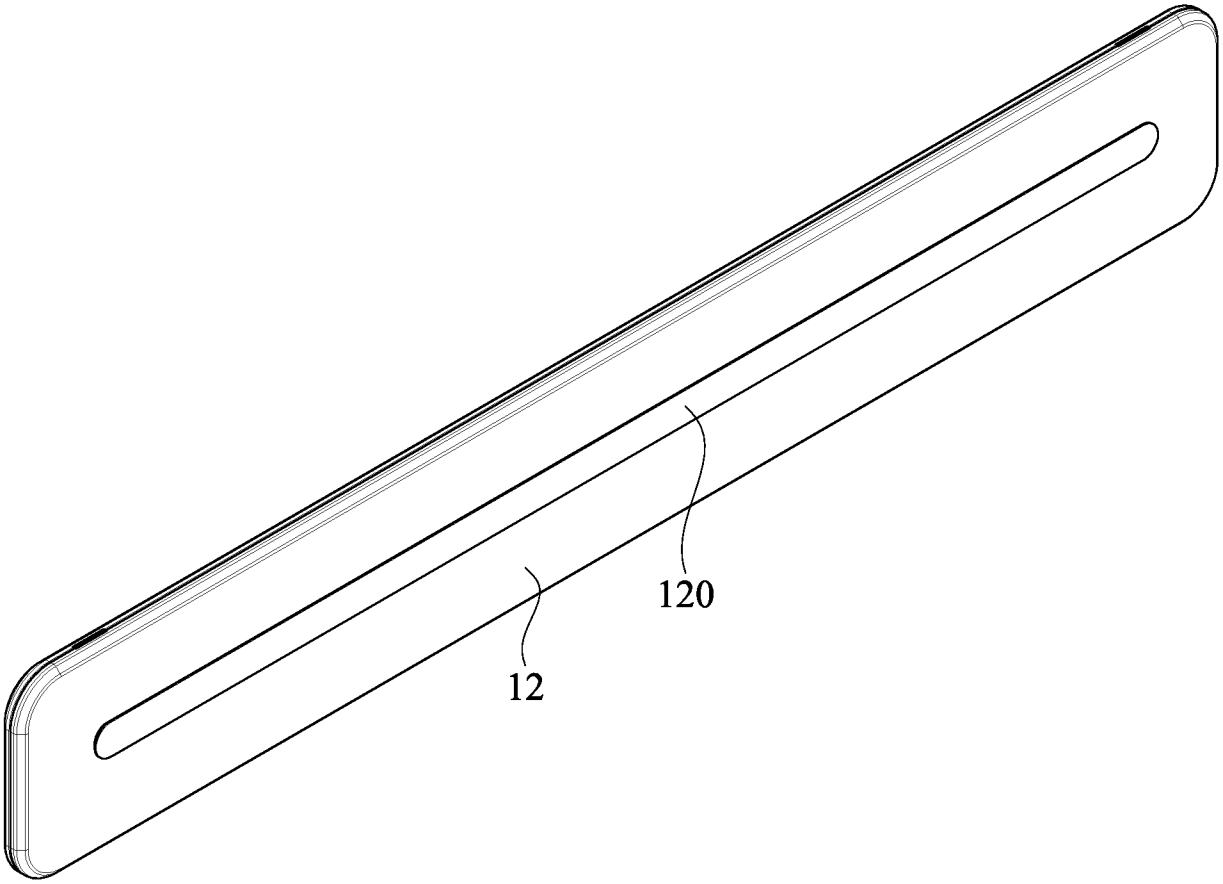
FIG. 2A illustrates a schematic three-dimensional diagram of a carrier member according to an exemplary embodiment of the instant disclosure.
Figure 2B:
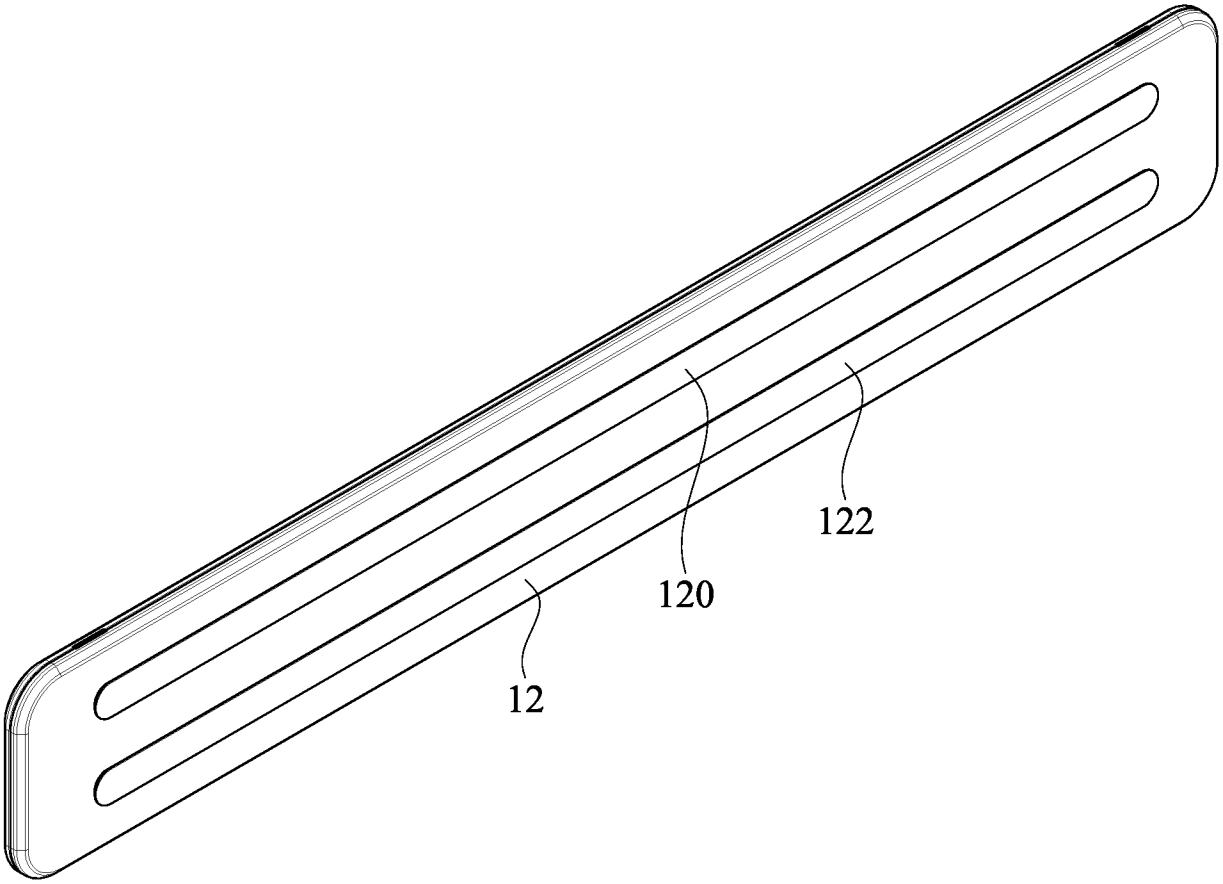
FIG. 2B illustrates a schematic three-dimensional diagram of a carrier member according to an exemplary embodiment of the instant disclosure.
Figure 2C:
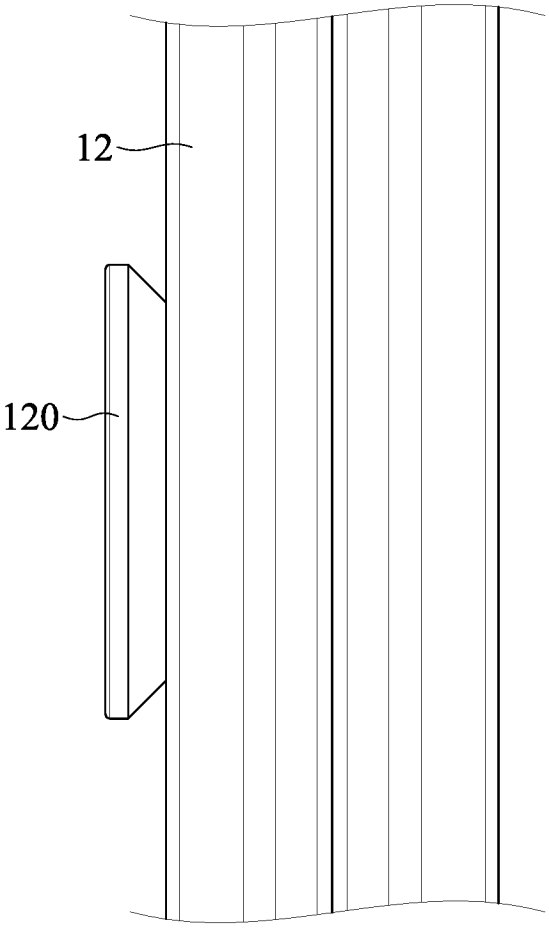
FIG. 2C illustrates a schematic side view of FIG. 3A.
Figure 2D:
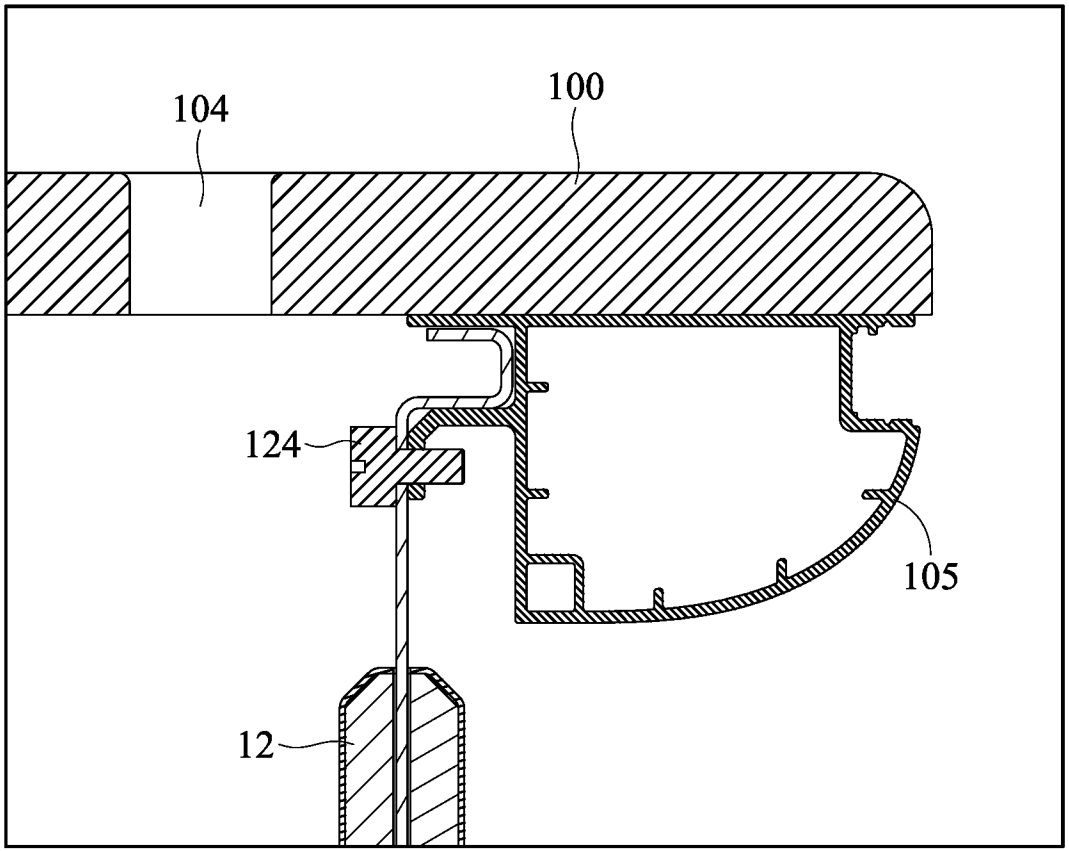
FIG. 2D illustrates a schematic diagram of the connection between a carrier member and a table body according to some exemplary embodiments of the instant disclosure.

FIG. 2A illustrates a schematic three dimensional diagram of the carrier member 12 according to an exemplary embodiment of the instant disclosure. FIG. 2B illustrates a schematic three dimensional diagram of the carrier member 12 according to an exemplary embodiment of the instant disclosure. FIG. 2C illustrates a schematic side view of FIG. 2A. FIG. 2D illustrates a schematic diagram of the connection between the carrier member 12 and the table body 10 according to some exemplary embodiments of the instant disclosure. Please refer to FIG. 1 through FIG. 2D. The carrier member 12 is connected to the table body 10 and located below the board 100. The connection between the carrier member 12 and the table body 10 may be achieved using one or more connectors 124 such as bolts, screws, pivot screws, or other common approaches. For example, in this embodiment, as shown in FIG. 2D, the carrier member 12 and the table body 10 are connected through screws and the frame 105. The carrier member 12 comprises a first slideway 120. In some embodiments, the carrier member 12 further comprises a second slideway 122 (please refer to FIG. 2B) parallel to the first slideway 120. The carrier member 12 may comprise even more slideways parallel to each other according to requirements. The first slideway 120 and the second slideway 122 may have the same structure. In some embodiments, as shown in FIG. 2A through FIG. 2C, the first slideway 120 is an elongated dovetail tenon. The first slideway 120 is adapted to allow objects to be slidably attached to the first slideway 120. For example, an object with a structure which can correspond to the shape of the first slideway 120 can be slidably attached to the first slideway 120 so that the slidably attached object can slide along the first slideway 120 to expand the flexibility of using the slidably attached object. Alternatively, the first slideway 120 may be magnetic so that objects such as magnets can be magnetically and slidably attached to the first slideway 120.

Figure 3A:
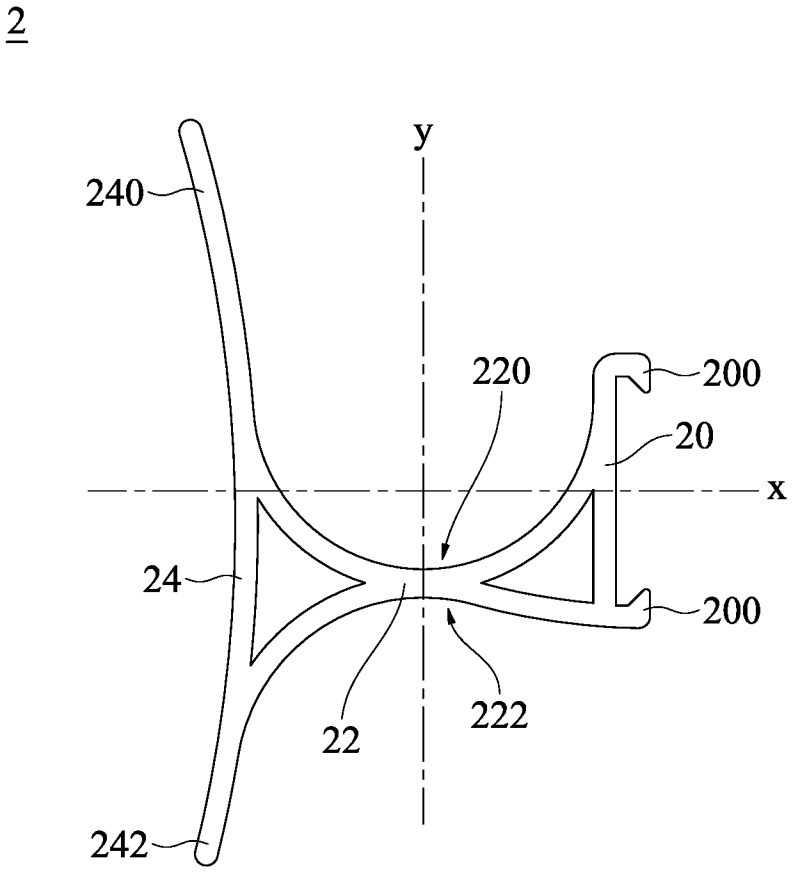
FIG. 3A illustrates a schematic two-dimensional diagram of a holder according to an exemplary embodiment of the instant disclosure.
Figure 3B:
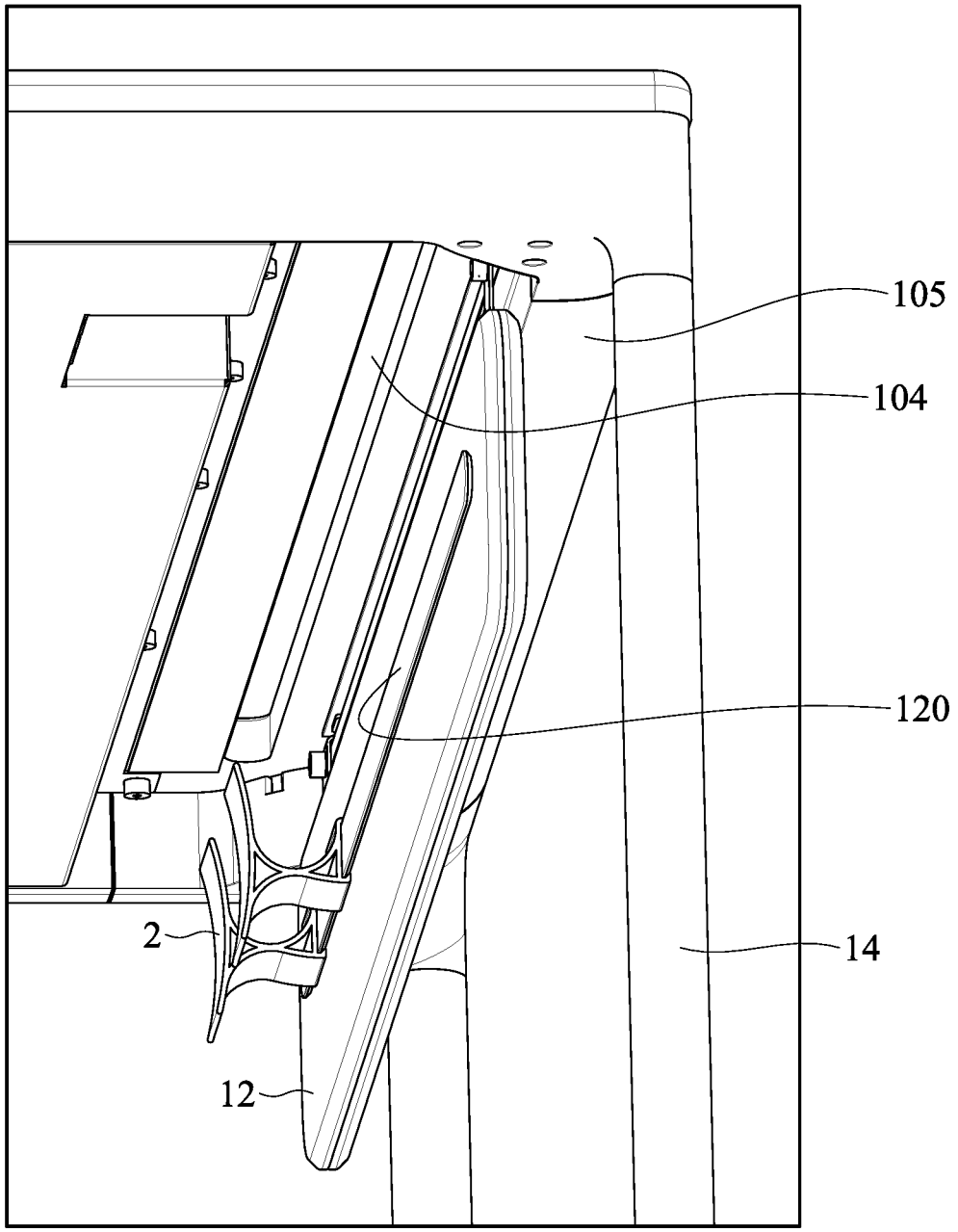
FIG. 3B illustrates a schematic diagram of holders corresponding to a groove according to an exemplary embodiment of the instant disclosure.

FIG. 3A illustrates a schematic two-dimensional diagram of the holder 2 according to an exemplary embodiment of the instant disclosure. FIG. 3B illustrates a schematic diagram of the holders 2 corresponding to the groove 104 according to an exemplary embodiment of the instant disclosure. Please refer to FIG. 3A and FIG. 3B. In some embodiments, the holder 2 comprises a slidable attaching portion 20 and a holding portion 22. The slidable attaching portion 20 is adapted to be slidably attached to the first slideway 120, and the holding portion 22 comprises a first holding surface 220. The first holding surface 220 corresponds to the groove 104 when the slidable attaching portion 20 is slidably attached to the first slideway 120 in a first attached state. In some embodiments, multiple holders 2 are slidably attached to the first slideway 120, and thus the held object can be more securely held, or multiple objects can be held at the same time. For example, as shown in FIG. 3B, two holders 2 are slidable attached to the first slideway 120. Similarly, in some embodiments, multiple holders 2 are slidably attached to the second slideway 122.

Please refer to FIG. 3A and FIG. 3B. In some embodiments, the slidable attaching portion 20 comprises a pair of hook portions 200. The first slideway 120 and the slidable attaching portion 20 are adapted to be slidably attached to each other through the shape of the hook portions 200. Basically, the shape of the hook portions 200 may be any shape that allows the slidably attaching portion 20 to be slid onto and attached to the first slideway 120 from one end of the first slideway 120, such as the left hand side or the right hand side of FIG. 2A, and then the holder 2 can slide along the first slideway 120. For example, in this embodiment, the shape of the slidably attaching portion 20 forms a dovetail mortise to match with the dovetail tenon shape of the first slideway 120. However, the shape of the slidably attaching portion 20 and the shape of the first slideway 120 do not have to be a perfect match, as long as the purpose of slidable attachment can be achieved. In the embodiments where the first slideway 120 and the second slideway 122 have the same structure, the slidable attaching portion 20 of the holder 2 can be selectively and slidably attached to the first slideway 120 or the second slideway 122.

Figure 4B:
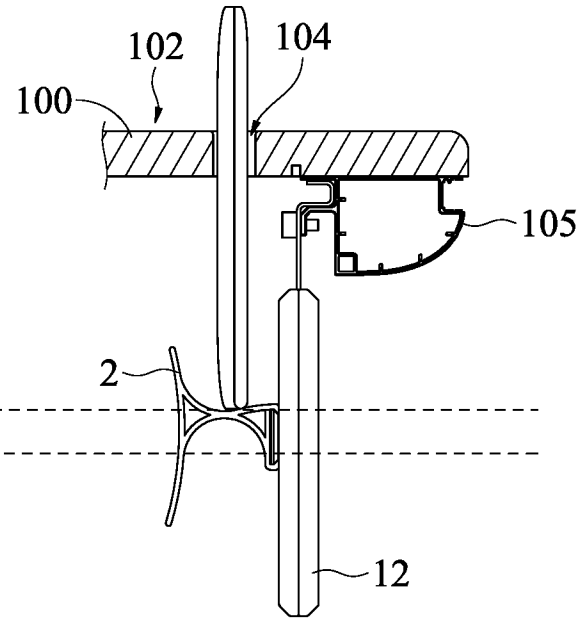
FIG. 4B illustrates a schematic side view of usage of a holder slidably attached to a first slideway in a second attached state according to an exemplary embodiment of the instant disclosure.
Figure 4A:
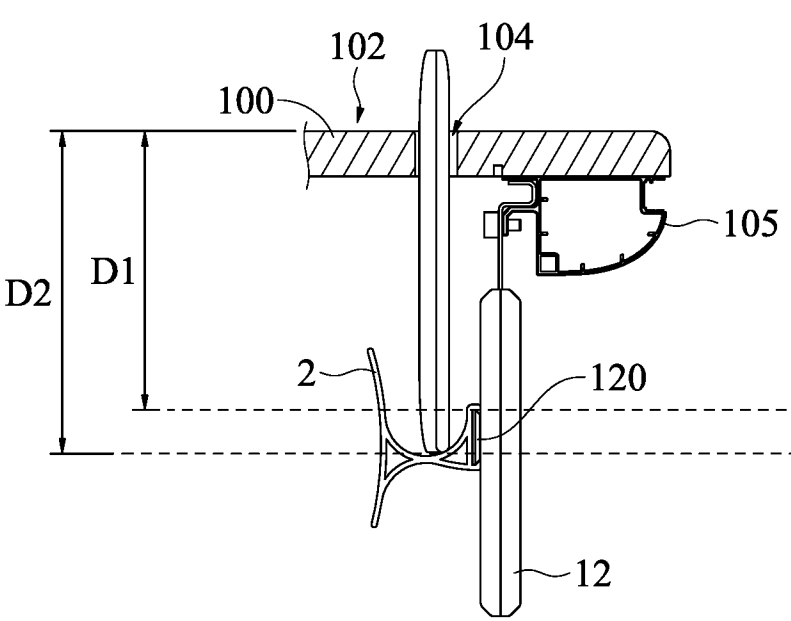
FIG. 4A illustrates a schematic side view of usage of a holder slidably attached to a first slideway in a first attached state according to an exemplary embodiment of the instant disclosure.

FIG. 4A illustrates a schematic side view of usage of the holder 2 slidably attached to the first slideway 120 in the first attached state according to an exemplary embodiment of the instant disclosure. FIG. 4B illustrates a schematic side view of usage of the holder 2 slidably attached to the first slideway 120 in the second attached state according to an exemplary embodiment of the instant disclosure. Please refer to FIG. 3A through FIG. 4B. In some embodiments, the holding portion 22 further comprises a second holding surface 222 opposite to the first holding surface 220. The second holding surface 222 corresponds to the groove 104 when the slidable attaching portion 20 is slidably attached to the first slideway 120 in a second attached state. In other words, the holder 2 may be slidably attached to the first slideway 120 in two ways: the first way (i.e., the first attached state) allows the first holding surface 220 to correspond to the groove 104 and makes the second holding surface 222 face away the groove 104, as shown in FIG. 4A, and the second way (i.e., the second attached state) allows the second holding surface 222 to correspond to the groove 104 and makes the first holding surface 220 face away the groove 104, as shown in FIG. 4B.

Please refer to FIG. 3A. In different embodiments, the first holding surface 220 and the second holding surface 222 may be planes or concave surfaces for different requirements. In some embodiments where the first holding surface 220 and the second holding surface 222 are concave surfaces, a deepest spot of the first holding surface 220 and a deepest spot of the second holding surface 222 are adjacent to a central y axis of the holder 2. In some embodiments, the deepest spot of the first holding surface 220 and the deepest spot of the second holding surface 222 are closer to the slidable attaching portion than the central y axis of the holder 2, so that the torque on the holder 2 induced by the held object can be lowered.

Please refer to FIG. 3A. In some embodiments, the holder 2 further comprises a stopping portion 24 connected to the holding portion 22 and opposite to the slidable attaching portion 20. The stopping portion 24 can further prevent the held object from sliding off the holder 2. In some embodiments, the stopping portion 24 comprises a first stopping arm 240 and a second stopping arm 242, the first stopping arm 240 corresponds to the first holding surface 220, the second stopping arm 242 corresponds to the second holding surface 222, and the first stopping arm 240 is longer than the second stopping arm 242; the longer length of the first stopping arm 240 compared with the second stopping arm 242 may provide better protection for the held object while not being too long so as to also prevent the user's legs from impacting the holder 2.

Please refer to FIG. 3A through FIG. 4B. In some embodiments, the first holding surface 220 and the second holding surface 222 are asymmetrical about a central x axis of the holder 2 shown in FIG. 3A. Consequently, the first holding surface 220 and the second holding surface 222 may have different depths. In some embodiments, a distance D1 between the table top 102 and a deepest spot of the first holding surface 220 when the slidable attaching portion 20 is slidably attached to the first slideway 120 in the first attached state is greater than a distance D2 between the table top 102 and a deepest spot of the second holding surface 222 when the slidable attaching portion 20 is slidably attached to the first slideway 120 in the second attached state. In other words, in some embodiments, the first holding surface 222 is deeper than the second holding surface 222 on the holder 2. This design allows the user to adjust the holding height for a specific held object. Therefore, the user may choose which holding surface should be used for a certain object to hold for the user's personal preferences or current requirements.

Figures 5A, 5B, 5C, 5D:
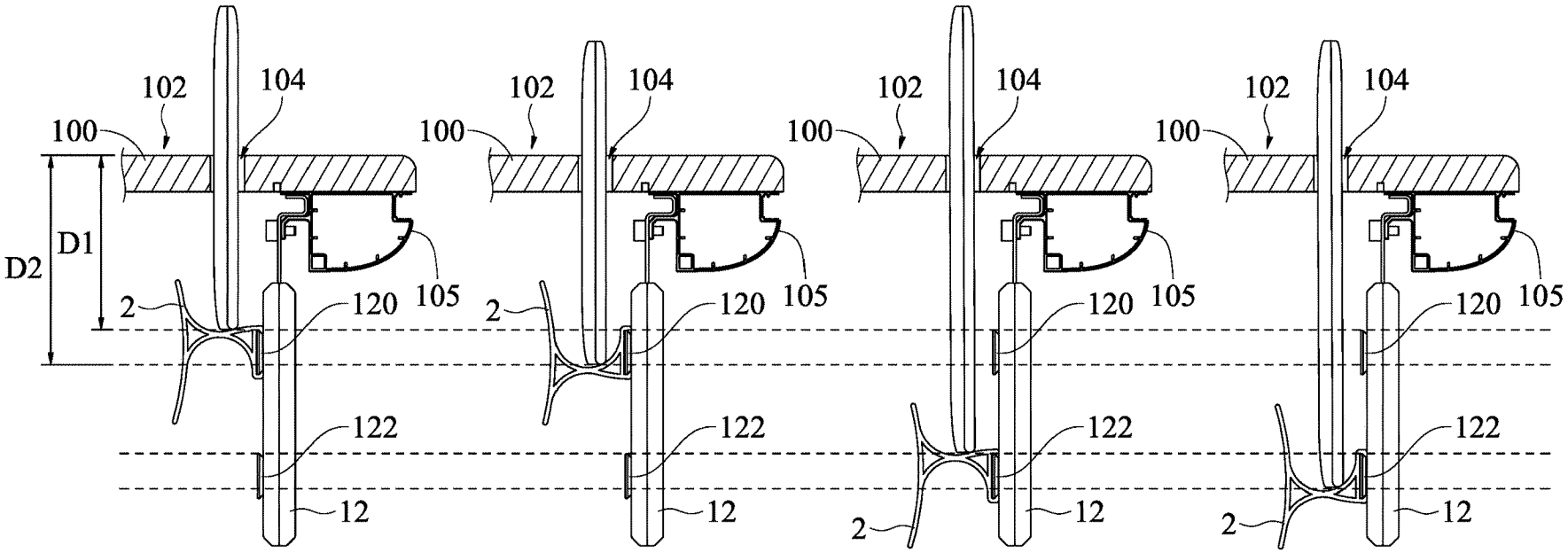
FIG. 5A illustrates a schematic side view of usage of a holder slidably attached to a first slideway in a first attached state according to an exemplary embodiment of the instant disclosure.
FIG. 5B illustrates a schematic side view of usage of a holder slidably attached to a first slideway in a second attached state according to an exemplary embodiment of the instant disclosure.
FIG. 5C illustrates a schematic side view of usage of a holder slidably attached to a second slideway in a first attached state according to an exemplary embodiment of the instant disclosure.
FIG. 5D illustrates a schematic side view of usage of a holder slidably attached to a second slideway in a second attached state according to an exemplary embodiment of the instant disclosure.

FIG. 5A illustrates a schematic side view of usage of the holder 2 slidably attached to the first slideway 120 in the first attached state according to an exemplary embodiment of the instant disclosure. FIG. 5B illustrates a schematic side view of usage of the holder 2 slidably attached to the first slideway 120 in the second attached state according to an exemplary embodiment of the instant disclosure. FIG. 5C illustrates a schematic side view of usage of the holder 2 slidably attached to the second slideway 122 in the first attached state according to an exemplary embodiment of the instant disclosure. FIG. 5D illustrates a schematic side view of usage of the holder 2 slidably attached to the second slideway 122 in the second attached state according to an exemplary embodiment of the instant disclosure. Please refer to FIG. 4A through FIG. 5D. The design goal of the holder 2 combined with the carrier member 12 and corresponding to the groove 104 is to allow flat devices such as, but not limited to, tablet computers and notebook computers to be lowered into and through the groove 104 and to be held by the holder 2 at a height so that only a third to half of the held device is visible above the table top 102 through the groove 104 in order to maintain a tidier look, save the majority of the area of the table top 102 for other usages, and allow the held object to ventilate better if heat dissipation is required for the held object. In some embodiments, the distance D1 between the table top 102 and a deepest spot of the first holding surface 220 is between 10 cm (centimeter) and 35 cm when the slidable attaching portion 20 is slidably attached to the first slideway 120 in the first attached state, and the distance D2 between the table top 102 and a deepest spot of the second holding surface 222 is between 10 cm and 35 cm when the slidable attaching portion 20 is slidably attached to the first slideway 120 in the second attached state. Similarly, it is desired that the same principle is applied when designing the position of the second slideway 122. This range of distance is defined based on currently available tablet computer devices and notebook computer devices. Specifically, currently, some of the smallest tablet computers are 7 inch in size, and some of the largest notebook computers are 17 inch in size. As technology advances, the range of distance may not be limited to between 10 cm and 35 cm in the future. Besides, the width of the groove 104 is not too wide; this will prevent some accidental falling of the held object due to accidental force on the held object above the table top 102 and keep the held object from impacting the side(s) of the groove 104 too hard.

Please refer to FIG. 5A through FIG. 5D. Specifically, the user may choose to make the first holding surface 220 or the second holding surface 222 correspond to the groove 104 to adjust the desired holding height for a specific object. Furthermore, the user may also choose to slidably attach the slidable attaching portion 20 of the holder 2 to the first slideway 120, the second slideway 122 or one of the other slideways (if more than two slideways are provided on the carrier member 12) to further adjust the desired holding height for a specific object. In other words, the user may choose to slidably attach the slidable attaching portion 20 of the holder 2 to the first slideway 120, the second slideway 122, or some other slideway in the first attached state or the second attached state to optimize the holding height for a specific object for the best user experience.

As above, some embodiments of the instant disclosure provide a multifunctional table having a flexible storage option to easily store tablet computer and notebook computer, prevent accidental damage to the stored tablet computer and notebook computer, save table area, increase ventilation and heat dissipation of the stored tablet computer and notebook computer, and improve overall user experience. Some embodiments of the instant disclosure provide a holder having two different holding surfaces for different holding purposes.

What is claimed is:

1. A multifunctional table comprising:

a table body comprising:

a board having a table top and a groove; and a support member connected to the board;

a carrier member connected to the table body, wherein the carrier member comprises a first slideway and a second slideway parallel to the first slideway, wherein a distance between the table top and the first slideway is less than a distance between the table top and the second slideway; and a holder comprising a slidable attaching portion and a holding portion connected to each other, wherein the slidable attaching portion is adapted to be selectively slidably attached to the first slideway or the second slideway, the holding portion comprises a first holding surface, and the first holding surface corresponds to the groove when the slidable attaching portion is slidably attached to the first slideway or the second slideway in a first attached state.

2. The multifunctional table according to claim 1, wherein the first slideway is an elongated dovetail tenon, the slidable attaching portion comprises a pair of hook portions, and the first slideway and the slidable attaching portion are adapted to be slidably attached to each other.

3. The multifunctional table according to claim 1, wherein the holding portion further comprises a second holding surface opposite to the first holding surface, the first holding surface and the second holding surface are asymmetrical about a central x axis of the holder, and the second holding surface corresponds to the groove when the slidable attaching portion is slidably attached to the first slideway or the second slideway in a second attached state.

4. A multifunctional table comprising:

a table body comprising:

a board having a table top and a groove; and a support member connected to the board;

a carrier member connected to the table body, wherein the carrier member comprises a first slideway; and a holder comprising a slidable attaching portion and a holding portion connected to each other, wherein the slidable attaching portion is adapted to be slidably attached to the first slideway, the holding portion comprises a first holding surface, and the first holding surface corresponds to the groove when the slidable attaching portion is slidably attached to the first slideway in a first attached state, wherein the holding portion further comprises a second holding surface opposite to the first holding surface, the first holding surface and the second holding surface are asymmetrical about a central x axis of the holder, and the second holding surface corresponds to the groove when the slidable attaching portion is slidably attached to the first slideway in a second attached state, and each of the first holding surface and the second holding surface is a concave surface having a deepest spot, a distance between the table top and the deepest spot of the first holding surface is between 10 cm (centimeter) and 35 cm when the slidable attaching portion is slidably attached to the first slideway in the first attached state, and a distance between the table top and the deepest spot of the second holding surface is between 10 cm and 35 cm when the slidable attaching portion is slidably attached to the first slideway in the second attached state.

5. The multifunctional table according to claim 3, wherein the first holding surface and the second holding surface are planes or concave surfaces.

6. The multifunctional table according to claim 5, wherein each of the first holding surface and the second holding surface is a concave surface having a deepest spot, and the deepest spot of the first holding surface and the deepest spot of the second holding surface are closer to the slidable attaching portion than a central y axis of the holding portion.

7. The multifunctional table according to claim 6, wherein the holder further comprises a stopping portion connected to the holding portion and opposite to the slidable attaching portion.

8. The multifunctional table according to claim 7, wherein the stopping portion comprises a first stopping arm and a second stopping arm, the first stopping arm corresponds to the first holding surface, the second stopping arm corresponds to the second holding surface, and the first stopping arm is longer than the second stopping arm.

9. The multifunctional table according to claim 1, wherein the holding portion further comprises a second holding surface opposite to the first holding surface, the second holding surface corresponds to the groove when the slidable attaching portion is slidably attached to the first slideway or the second slideway in a second attached state, each of the first holding surface and the second holding surface is a concave surface having a deepest spot, and a distance between the table top and the deepest spot of the first holding surface when the slidable attaching portion is slidably attached to the first slideway or the second slideway in the first attached state is greater than a distance between the table top and the deepest spot of the second holding surface when the slidable attaching portion is slidably attached to the first slideway or the second slideway in the second attached state.

10. The multifunctional table according to claim 9, wherein the distance between the table top and the deepest spot of the first holding surface is between 10 cm and 35 cm when the slidable attaching portion is slidably attached to the first slideway in the first attached state, and the distance between the table top and the deepest spot of the second holding surface is between 10 cm and 35 cm when the slidable attaching portion is slidably attached to the first slideway in the second attached state.

11. The multifunctional table according to claim 9, wherein the deepest spot of the first holding surface and the deepest spot of the second holding surface are closer to the slidable attaching portion than a central y axis of the holding portion.

12. The multifunctional table according to claim 11, wherein the holder further comprises a stopping portion connected to the holding portion and opposite to the slidable attaching portion.

13. The multifunctional table according to claim 12, wherein the stopping portion comprises a first stopping arm and a second stopping arm, the first stopping arm corresponds to the first holding surface, the second stopping arm corresponds to the second holding surface, and the first stopping arm is longer than the second stopping arm.

14. A holder comprising a slidable attaching portion and a holding portion connected to each other, wherein the holding portion comprises a first holding surface and a second holding surface opposite to each other, the first holding surface and the second holding surface are asymmetrical about a central x axis of the holder, each of the first holding surface and the second holding surface is a concave surface having a deepest spot, and the deepest spot of the first holding surface and the deepest spot of the second holding surface are closer to the slidable attaching portion than a central y axis of the holding portion.

15. The holder according to claim 7, wherein the holder further comprises a stopping portion connected to the holding portion and opposite to the slidable attaching portion.

16. The holder according to claim 15, wherein the stopping portion comprises a first stopping arm and a second stopping arm, the first stopping arm corresponds to the first holding surface, the second stopping arm corresponds to the second holding surface, and the first stopping arm is longer than the second stopping arm.

* * * * *